US006186828B1

(12) United States Patent
O'Sullivan

(10) Patent No.: US 6,186,828 B1
(45) Date of Patent: Feb. 13, 2001

(54) ELECTRICAL CONNECTOR INCLUDING COAXIAL CABLE MANAGEMENT SYSTEM

(75) Inventor: Michael O'Sullivan, Willowbrook, IL (US)

(73) Assignee: Molex Incorporated, Lisle, IL (US)

( * ) Notice: Under 35 U.S.C. 154(b), the term of this patent shall be extended for 0 days.

(21) Appl. No.: 09/386,104

(22) Filed: Aug. 30, 1999

(51) Int. Cl.[7] ..... H01R 9/05
(52) U.S. Cl. ..... 439/579
(58) Field of Search ..... 439/101, 108, 439/497, 579, 610

(56) References Cited

U.S. PATENT DOCUMENTS

| | | | | |
|---|---|---|---|---|
| 3,828,298 | | 8/1974 | Schumacher | 339/14 |
| 4,408,816 | * | 10/1983 | Murphy | 439/610 |
| 4,502,743 | | 3/1985 | Ziegler | 339/14 |
| 4,813,888 | | 3/1989 | Tokizane et al. | 429/583 |
| 4,842,544 | | 6/1989 | Birch et al. | 439/387 |
| 4,990,104 | | 2/1991 | Schieferly | 439/578 |
| 5,292,256 | | 3/1994 | Brunker et al. | 439/108 |
| 5,304,069 | | 4/1994 | Brunker et al. | 439/108 |
| 5,419,709 | * | 5/1995 | Onoda | 439/95 |
| 5,466,175 | * | 11/1995 | Onoda | 439/610 |
| 5,518,421 | * | 5/1996 | Davis | 439/607 |
| 5,518,428 | * | 5/1996 | Onoda | 439/752 |
| 5,618,202 | | 4/1997 | Okuyama et al. | 439/497 |
| 5,711,686 | | 1/1998 | O'Sullivan et al. | 439/610 |
| 5,716,236 | | 2/1998 | O'Sullivan et al. | 439/610 |
| 5,718,607 | | 2/1998 | Murphy et al. | 439/610 |
| 5,725,387 | | 3/1998 | O'Sullivan et al. | 439/98 |
| 5,733,146 | * | 3/1998 | Block | 439/610 |
| 5,823,825 | * | 10/1983 | Murphy | 439/610 |

FOREIGN PATENT DOCUMENTS

WO 94/26004 11/1994 (EP) .

* cited by examiner

*Primary Examiner*—Brian Sircus
*Assistant Examiner*—Thanh-Tam Le
(74) *Attorney, Agent, or Firm*—Robert J. Zeitler

(57) ABSTRACT

An electrical connector includes a dielectric housing and a plurality of terminals mounted therein. A conductive ground blade is mounted in the housing and includes at least a pair of positioning arms projecting therefrom for engaging the metallic shields of a pair of coaxial cables. An independent cable management member is mounted on the housing and includes a partition extending between the positioning arms to separate the coaxial cables and maintain the metallic shields near the positioning arms.

18 Claims, 8 Drawing Sheets

ELECTRICAL CONNECTOR INCLUDING COAXIAL CABLE MANAGEMENT SYSTEM

FIELD OF THE INVENTION

This invention generally relates to the art of electrical connectors and, particularly, to a connector for a plurality of coaxial cables and including a system for terminating the metallic shields of high speed cables, such as the metallic braids of the cables.

BACKGROUND OF THE INVENTION

A typical high speed cable includes a center conductor or core surrounded by a tube-like inner dielectric. A shield is disposed outside the inner dielectric for shielding and/or grounding the cable. The shield typically is a tubular metallic braid. However, one or more longitudinal conductive wires have also been used and are commonly called "drain wires." An insulating jacket surrounds the composite cable outside the shield.

Various types of connectors are used to terminate high speed cables. The connectors typically have contacts which are terminated to the center conductor or core of the cable. The connectors also have one form or another of a terminating member for terminating the metallic shield of the high speed cable, usually for grounding purposes. A typical system in such connectors may terminate the metallic shield to the terminating member by soldering or welding. Other systems use crimping procedures to crimp at least a portion of the terminating member securely to the metallic braid.

With the ever-increasing miniaturization of the electronics in various industries, such as in the computer and telecommunications industries, along with the accompanying miniaturization of electrical connectors, considerable problems have been encountered in terminating miniature high speed cables, particularly in terminating the metallic shield of the cable. For instance, the outside diameter of a small coaxial cable may be on the order of 0.090 inch. The outside diameter of the inner dielectric surrounding the conductor/core may be on the order of 0.051 inch, and the diameter of the center conductor/core may be on the order of 0.012 inch. Coaxial cables having even smaller dimensional parameters have been used.

The problems in terminating small coaxial cables often revolve around terminating the metallic shield of the cable. For instance, if soldering methods are used, applying heat (necessary for soldering) in direct proximity to the metallic shield can cause heat damages to the underlying inner dielectric and, in fact, substantially disintegrate or degrade the inner dielectric. If conventional crimp-type terminations are used, typical crimping forces often will crush or deform the inner dielectric surrounding the center conductor/core of the cable. In either case, damage or deformation of the inner dielectric will change the electrical characteristics of the cable.

The above problems are further complicated when the metallic shield of the high speed cable is not terminated to a cylindrical terminating member, but the shield is terminated to a flat terminating member or contact. For instance, an example of terminating the metallic shield or braid of a coaxial cable to a flat ground member is shown in U.S. Pat. No. 5,304,069, dated Apr. 19, 1994 and assigned to the assignee of the present invention. In that patent, the metallic braids of a plurality of coaxial cables are terminated to a ground plate of a high speed signal transmission terminal module. The conductors/cores of the coaxial cables are terminated to signal terminals of the module. Other examples are shown in U.S. Pat. No. 5,711,686, dated Jan. 27, 1998; U.S. Pat. No. 5,716,236, dated Feb. 10, 1998; U.S. Pat. No. 5,718,607, dated Feb. 17, 1998; U.S. Pat. No. 5,725,387, dated Marc. 10, 1998; and U.S. Pat. No. 5,785,555 dated Jul. 28, 1998, all of which are assigned to the assignee of the present invention.

The present invention is directed to further improvements in managing the termination of high speed coaxial cables, including the termination of the metallic shields of a plurality of cables to a terminating member, such as a ground blade.

SUMMARY OF THE INVENTION

An object, therefore, of the invention is to provide a new and improved electrical connector which includes a system for terminating the metallic shields of high speed cables.

In the exemplary embodiment of the invention, the connector includes a dielectric housing having a front mating face and a rear terminating face, a plurality of terminal-receiving passages extending generally between the faces, and a blade-receiveng passage extending generally between the faces. A plurality of terminals are received in the terminal-receiving passages. A conductive ground blade is received in the blade-receiveng passage. The ground blade includes at least a pair of positioning arms projecting from the ground blade at the rear terminating face of the housing for engaging the metallic shields of a pair of coaxial cables. An independent cable management member is mounted on the housing and includes a partition extending between the positioning arms to separate the coaxial cables and maintain the metallic shields near the positioning arms.

As disclosed herein, the ground blade is generally planar and includes a slot. The cable management member includes a wall portion projecting through the slot and between the positioning arms to provide an abutment shoulder to prevent the ground blade from backing out of the blade-receiving passage. The ground blade includes a pair of the positioning arms projecting from each opposite side thereof, with a partition on the cable management member extending between each pair of arms. This defines four quadrants for accommodating four coaxial cables. Four terminal-receiving passages are provided in the housing aligned with the four quadrants for receiving four signal terminals.

The invention also contemplates that a shield be disposed about at least a portion of the housing and engaging at least a portion of the cable management member to hold the member on the housing. The cable management member includes at least one locating projection disposed in a locating recess in the housing. The locating projection is on an arm of the cable management member, and the shield engages the arm to hold the cable management member on the housing.

Other objects, features and advantages of the invention will be apparent from the following detailed description taken in connection with the accompanying drawings.

BRIEF DESCRIPTION OF THE DRAWINGS

The features of this invention which are believed to be novel are set forth with particularity in the appended claims. The invention, together with its objects and the advantages thereof, may be best understood by reference to the following description taken in conjunction with the accompanying drawings, in which like reference numerals identify like elements in the figures and in which:

DETAILED DESCRIPTION OF THE PREFERRED EMBODIMENT

Figure 1:
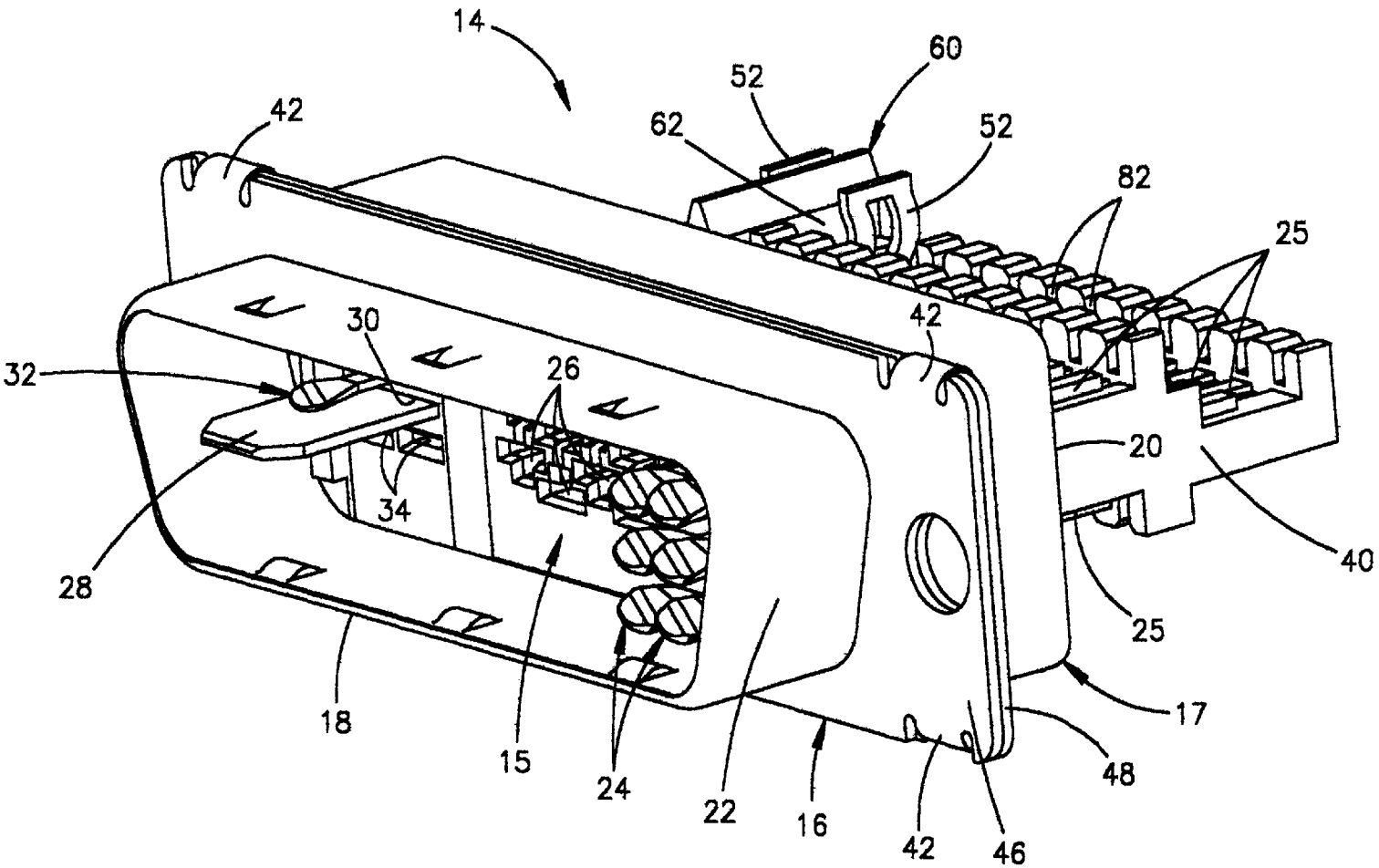
FIG. 1 is a front perspective view of an electrical connector embodying the concepts of the invention.

Referring to the drawings in greater detail, and first to FIGS. 1–5, the invention is embodied in an electrical connector, generally designated 14, which includes a dielectric housing, generally designated 15, substantially surrounded by a front shield, generally designated 16, and a back shield, generally designated 17. The housing is a one-piece structure unitarily molded of dielectric material such as plastic or the like. Each shield 16 and 17 is a one-piece structure stamped and formed or drawn of conductive sheet metal material.

The connector is an input/output (I/O) electrical device wherein front shield 16 defines a front mating face 18 of the connector, and rear shield 17 defines a rear terminating face 20. The front face actually is formed by a shroud 22 of shield 16 surrounding forwardly projecting contact portions of three rows of data transmission terminals, generally designated 24. The data transmission terminals project through terminal-receiving passages 26 in the connector housing and have rear tail portions 25. A conductive ground blade 28 projects through a blade-receiving passage 30 in the connector housing. A pair of high speed signal terminals 32 project through a pair of terminal-receiving passages 34 in the housing on each opposite side of ground blade 28. Terminating or tail portions 36 (FIG. 2) of high speed signal terminals 32 project rearwardly of rear shield 17 on a rear platform 40 of the connector housing.

Figure 2:
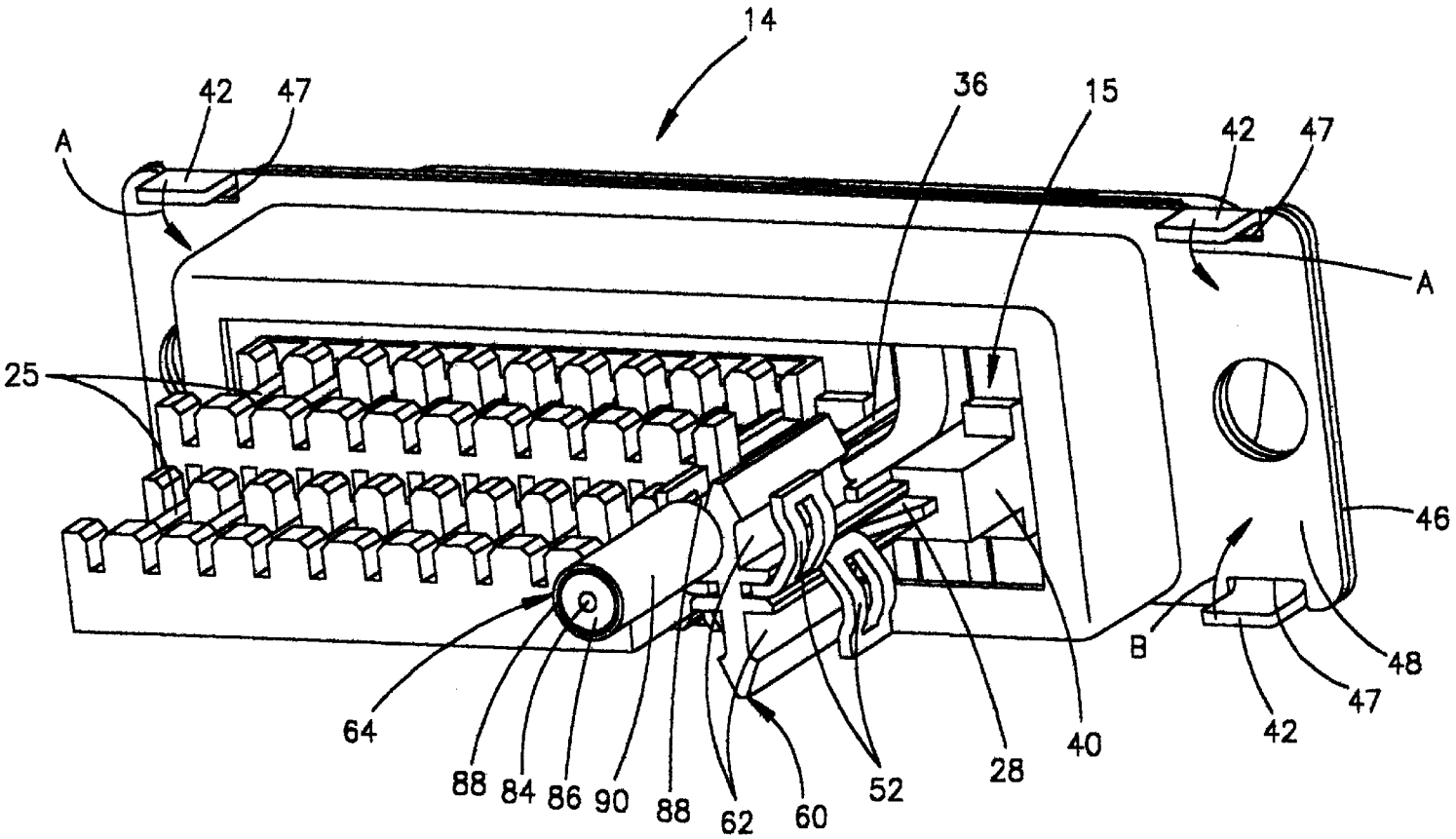
FIG. 2 is a rear perspective view of the connector.

Only one of the high speed signal terminals 32 is shown in FIGS. 1 and 2, but it is understood that a pair of the high speed signal terminals are disposed on each opposite side of ground blade 28. Similarly, only six data transmission terminals 24 are shown in FIG. 1, but thirty of such terminals may be arranged in three rows of passages 26 in the connector housing.

Front shield 16 has a pair of rearwardly projecting tabs 42 on both the top and bottom thereof. The tabs project rearwardly of a base plate 46 of the front shield through notches 47 in a base plate 48 of the rear shield. The top tabs are bent downwardly in the direction of arrows "A" (FIG. 2), and the bottom tabs are bent upwardly in the direction of arrow "B". This secures the front and rear shields rigidly together about connector housing 15.

Figure 3:
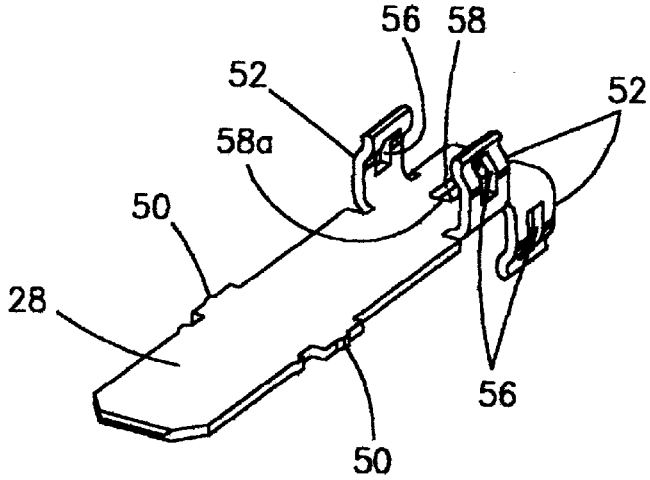
FIG. 3 is a front perspective view of the ground blade of the connector.
Figure 4:
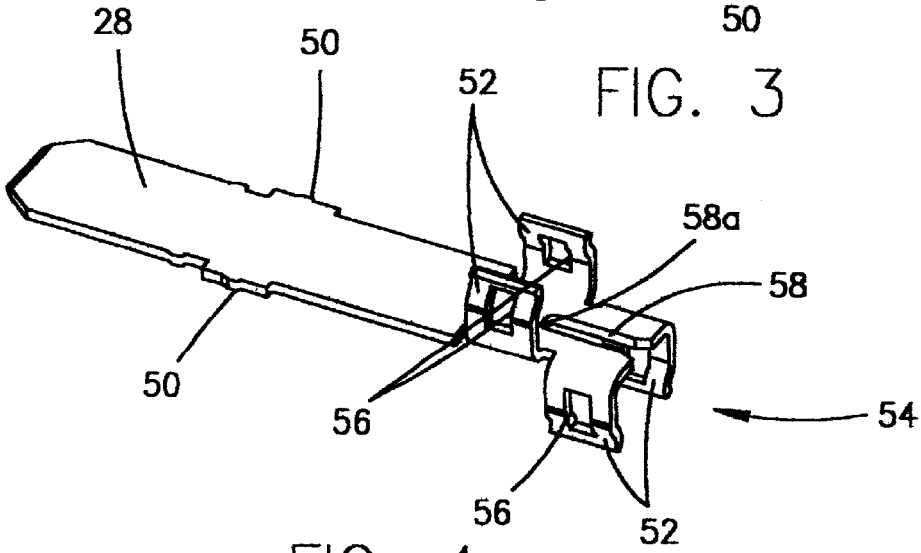
FIG. 4 is a rear perspective view of the ground blade.

Before proceeding with further details of the interior of the connector assembly, reference is made to FIGS. 3 and 4 which show details of conductive ground blade 28. The blade is stamped and formed of sheet metal material. As can be seen, the blade is elongated and generally planar to define a long ground plate. Barbs 50 are stamped at opposite edges of the ground blade for establishing an interference fit within blade-receiving passage 30 of the housing. A pair of positioning arms 52 project from each opposite side of the ground blade at a rear terminating end 54 thereof. Each positioning arm includes a stamped window 56. The positioning arms are arcuately shaped for engaging a metallic shield, such as metallic braids of coaxial cables. The positioning arms are soldered to the metallic shields, and windows 56 allow for the flow of solder material through the arms and into engagement with the shields. A slot 58 is formed in ground blade 28. The slot is open at rear end 54 of the blade and has a closed end **58*a*** which defines an abutment shoulder, for purposes described hereinafter.

Figure 5:
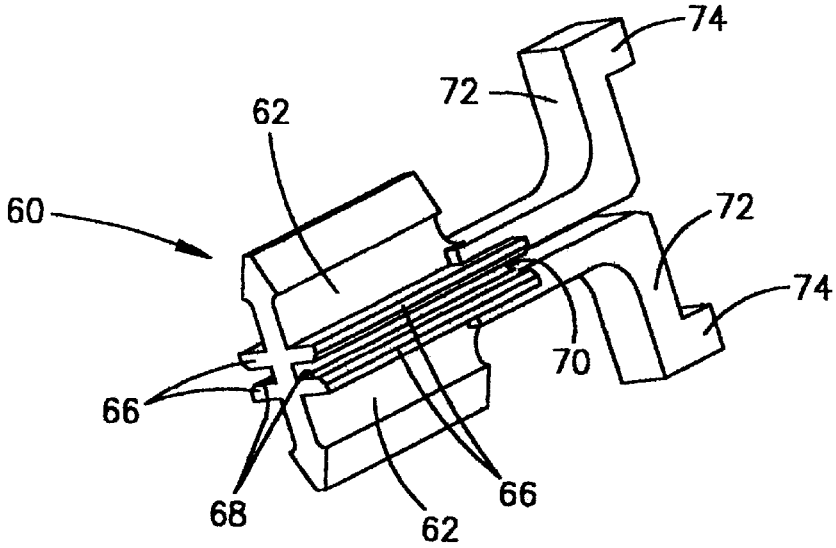
FIG. 5 is a rear perspective view of the cable management member.

FIG. 5 shows a cable management member, generally designated 60, according to the invention. The cable management member includes a pair of oppositely extending partitions or walls 62 which extend between the upper and lower pairs of positioning arms 52 at the rear end of ground blade 28 as seen in FIGS. 1 and 2. The partitions have sloped entry surfaces 63 to guide the cables into position and catches 65 to retain the cables after they have been inserted therein. As such, partitions 62 and positioning arms 52 are effective to provide a cable management system which is divided into four quadrants for receiving four coaxial cables 64 (FIG. 2) terminated to tails 36 of the four high speed signal terminals 32 in the four passages 34 in the connector housing, as described above. In essence, the tails 36 of the four high speed signal terminals are aligned with the four quadrants defined by partitions 62 of cable management member 60 and positioning arms 52 of ground blade 28. The cable management member has a pair of longitudinal flanges 66 on each opposite side thereof to define channels 68 for receiving the planar portions of the ground blade on opposite sides of slot 58 (FIGS. 3 and 4). A front abutment surface 70 (FIG. 5) of cable management member 60 abuts against the closed end **58*a* of slot 58 to prevent the ground blade from backing out of its passage in the connector housing. In other words, after the ground blade is inserted into the rear of housing 15, assembly of cable management member 60 to the housing causes abutment shoulder 70 of the cable management member to engage abutment end 58*a* of slot 58 in the ground blade, whereby the cable management member is effective to prevent the ground blade from backing out of the housing. Still referring to FIG. 5, cable management member 60 is assembled to connector housing 15 by means of a pair of arms 72 having forwardly directed locating projections 74. The locating projections are received in locating recesses in the connector housing, as described hereinafter. Alternatively, the ground blade 28 and the cable management member 60 may be preassembled, and then the ground blade/cable management member subassembly is installed onto the rear of housing 15**.

Figure 6:
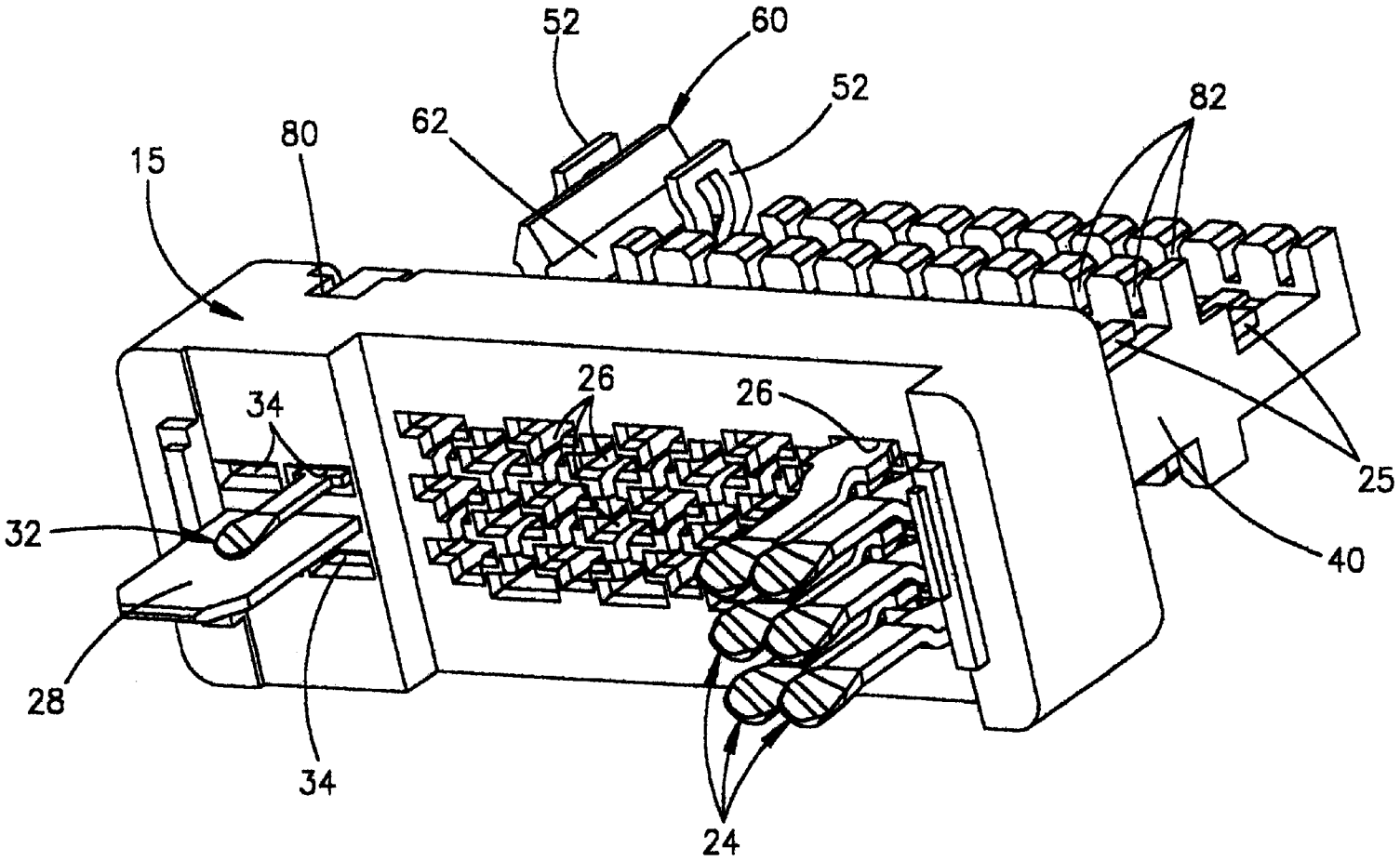
FIG. 6 is a front perspective view of the connector, with the shield removed.
Figure 7:
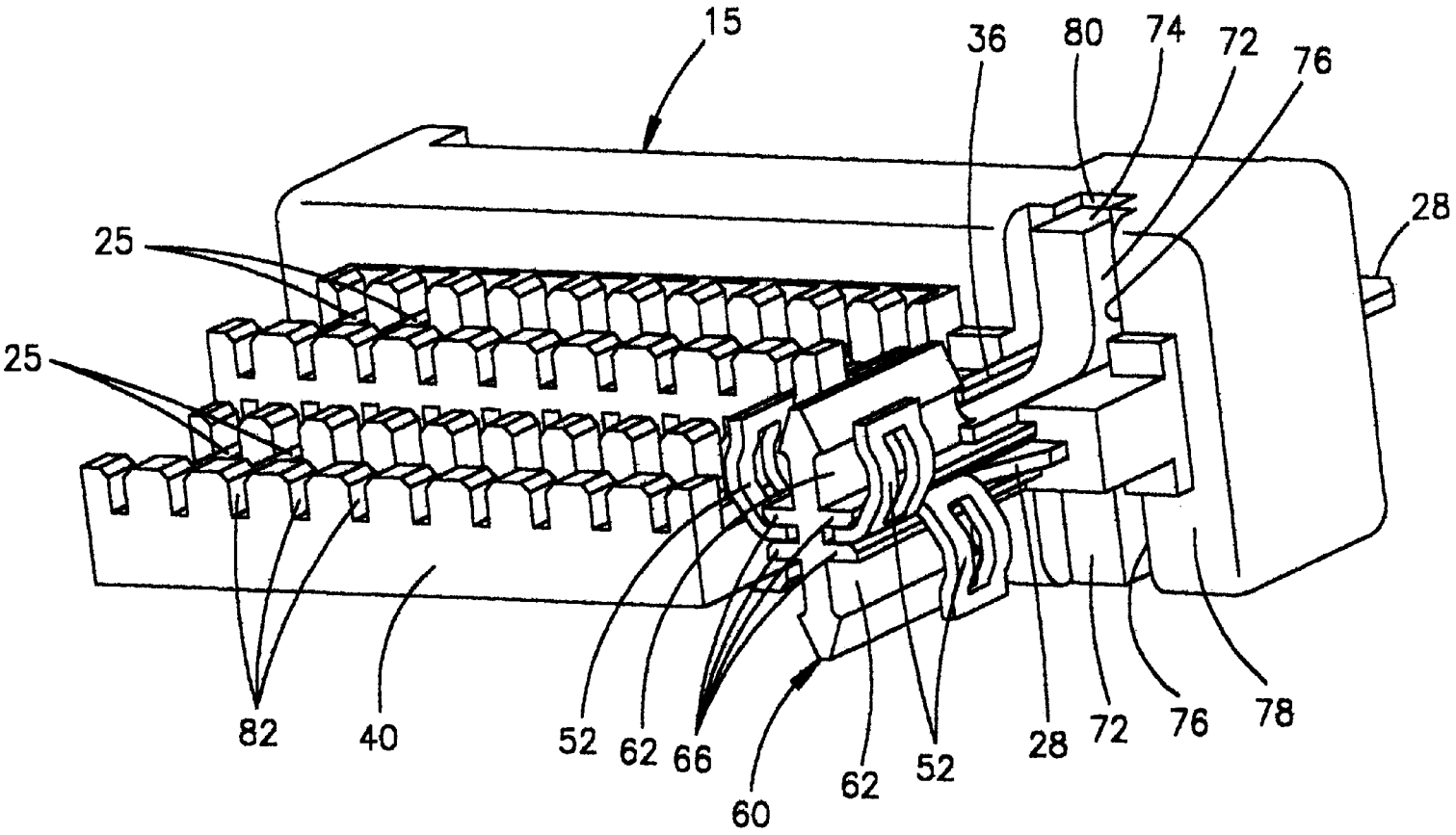
FIG. 7 is a rear perspective view similar to that of FIG. 6.
Figure 8:
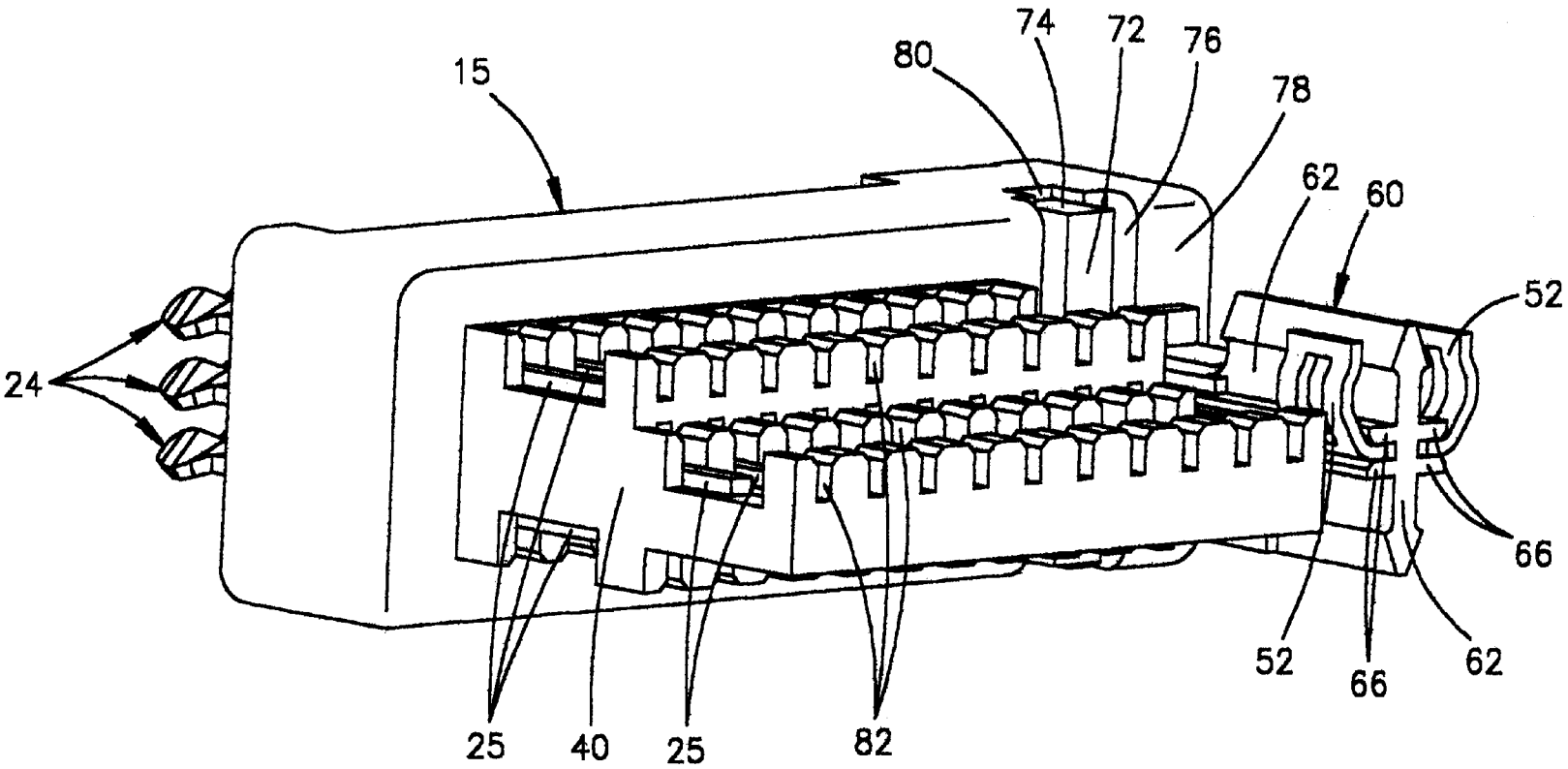
FIG. 8 is a rear perspective view taken at a different angle from that of FIG. 7.
Figure 9:
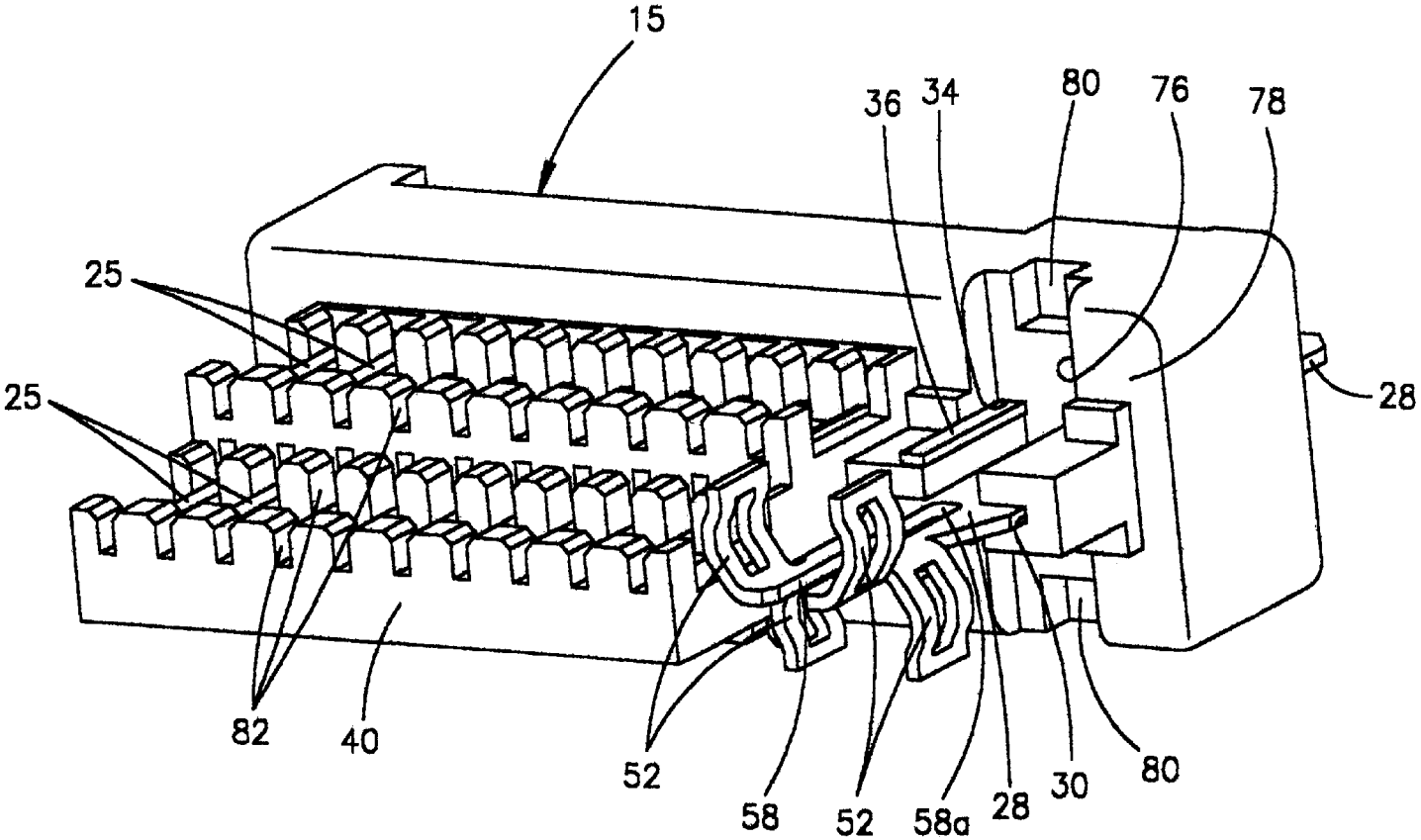
FIG. 9 is a rear perspective view of only the housing and the ground blade.
Figure 10:
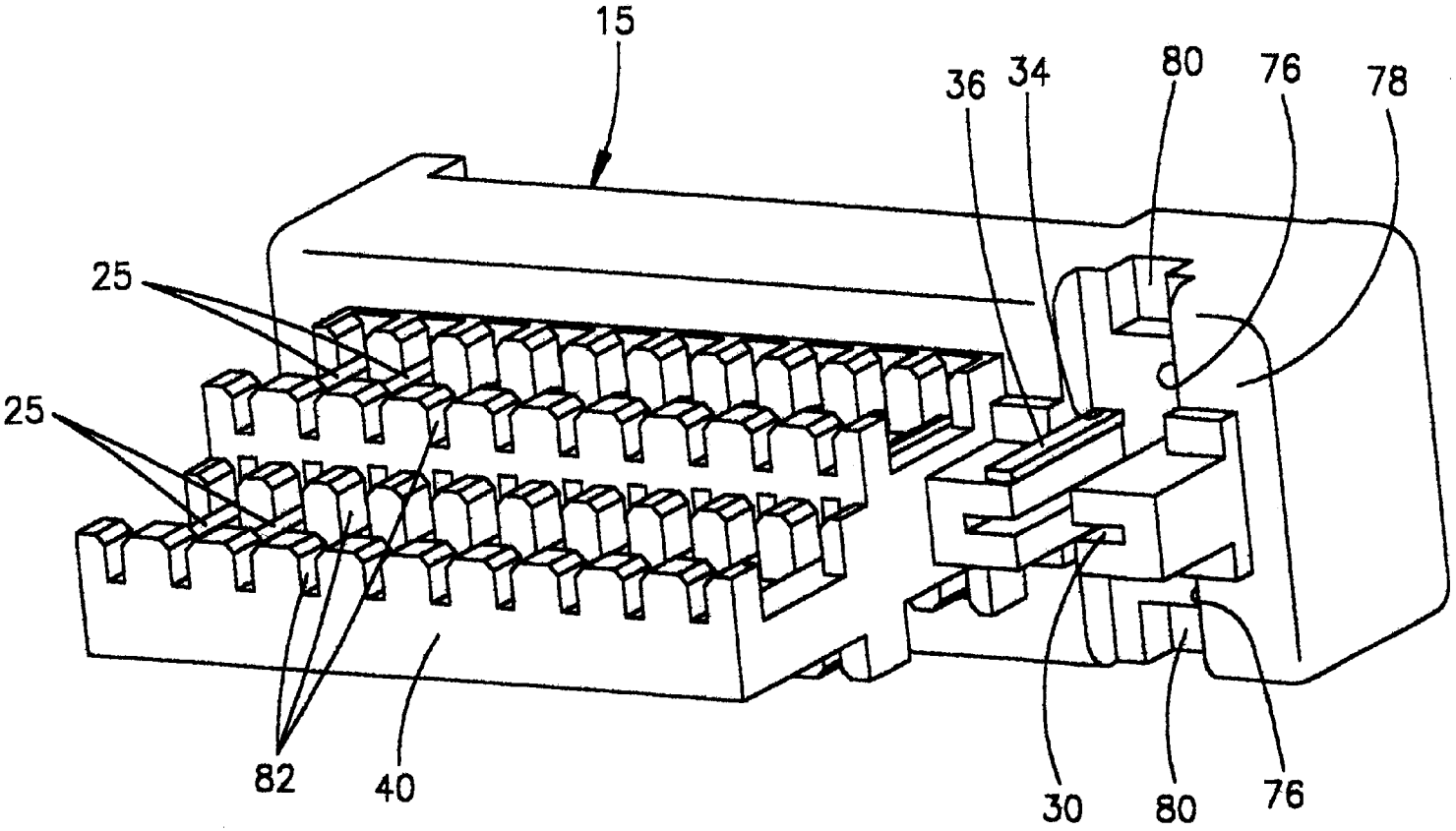
FIG. 10 is a rear perspective view of the housing, alone.

FIGS. 6–8 show the interior components of connector 14, i.e. with front and rear shields 16 and 17, respectively, removed. Arms 72 of cable management member 60 are located in slots 76 in a rear face 78 of housing 15. It can be seen how partitions 62 of the cable management member cooperate with positioning arms 52 of ground blade 28 to provide a cable management system defining four quadrants between the partitions and the positioning arms. FIGS. 9 and 10 show that connector housing 15 includes a pair of locating recesses 80 above and below blade-receiving passage 30 for receiving locating projections 74 (FIG. 5) of cable management member 60. The locating projections can be press-fit into locating recesses 80, if desired, to provide a preliminary holding means for the cable management member. It should be understood that rear shield 17 abuts against the rear of arms 72 (FIG. 5) to hold the cable management member in its assembly position. Finally, FIGS. 9 and 10 show that platform 40 of the housing has notches 82 to facilitate the termination of discrete electrical wires to tail portions 25 of data transmission terminals 24.

As is known in the art, a typical coaxial cable 64 (FIG. 2) has an inner conductor 84, an inner dielectric 86 surrounding the inner conductor, a metallic shield or braid 88 surrounding the inner dielectric and an outer insulating jacket 90 surrounding the metallic shield. In terminating cable 64 to tail portion 36 of one of the high speed signal terminals 32, and terminating metallic shield 88 of the conductor to arms 52 of ground blade 28, outer jacket 90 of the cable is removed to expose a portion of metallic shield 88 at a location for engaging one of the positioning arms 52 and a portion of the inner dielectric 86 is removed to expose the inner conductor 84. The shield is either cut or folded back to expose a distal end of inner conductor 84 for solder connection to tail portion 36 of one of the high speed terminals 32. The cable is then positioned in the quadrant defined by the partition 62 and the positioning arm 52. When so placed, the metallic braid of the coaxial cable is juxtaposed with the positioning arm 52 and can be easily soldered thereto with the window 56 allowing for the flow of solder material into engagement with the shield. In addition, the inner conductor is aligned such that it is in juxtaposition with the tail portion 36 of signal terminal 32 and can be easily soldered together. Although only one cable 64 is shown in FIG. 2, four such cables can be very easily terminated to ground blade 28 and terminal tails 36, because partitions 62 of cable management member 60 cooperate with positioning arms 52 of the ground blade to divide the termination area of the cables into four quadrants for properly positioning the cables.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

What is claimed is:

1. An electrical connector, comprising:

a dielectric housing including a front mating end and a rear terminating end, a plurality of terminal-receiving passages extending generally between said ends, and a blade-receiving passage extending generally between the ends;

a plurality of conductive terminals received in said terminal-receiving passages;

a conductive ground blade received in said blade-receiveng passage and including at least a pair of positioning arms projecting from the ground blade at the rear terminating end of the housing for engaging metallic shields of a pair of coaxial cables; and an independent cable management member mounted on the housing and including a partition extending between said positioning arms to separate the coaxial cables and maintain the metallic shields near the positioning arms.

2. The electrical connector of claim 1 wherein said cable management member includes an abutment shoulder for engaging an abutment shoulder on the ground blade to prevent the blade from backing out of the blade-receiving passage.

3. The electrical connector of claim 1 wherein said ground blade is generally planar and includes a slot, and said cable management member includes a portion projecting through the slot and between the positioning arms.

4. The electrical connector of claim 1, including a pair of said positioning arms projecting from each opposite side of the ground blade, with a partition on the cable management member extending between each pair of arms to define four quadrants for accommodating four coaxial cables.

5. The electrical connector of claim 4, including four of said terminal-receiving passages in the housing aligned with said four quadrants for receiving four signal terminals.

6. The electrical connector of claim 1 wherein said housing includes at least one locating recess and the cable management member includes at least one locating projection disposed in the recess.

7. The electrical connector of claim 6 wherein said locating projection is on an arm of the cable management member, and including a shield about at least a portion of the housing and engageable with the arm to hold the cable management member on the housing.

8. The electrical connector of claim 6 wherein said locating projection is press-fit into said locating recess.

9. The electrical connector of claim 1, including a shield about at least a portion of the housing and engaging at least a portion of the cable management member to hold the member on the housing.

10. A termination system for terminating at least a pair of coaxial cables each having an inner conductor, an inner dielectric surrounding at least a portion of said inner conductor, a metallic shield surrounding at least a portion of the inner dielectric and an outer insulating jacket surrounding at least a portion of the metallic shield, a portion of the outer jacket of each of the cables being removed to expose a portion of the metallic shield, comprising:

a connector including a dielectric housing;

a plurality of conductive terminals mounted in the housing;

a conductive ground blade mounted in the housing and including at least a pair of spaced positioning arms for engaging the metallic shields of the pair of coaxial cables; and an independent cable management member mounted on the housing and including a partition extending between the positioning arms to separate the coaxial cables and maintain the metallic shields near the positioning arms.

11. The system of claim 10, including complementary interengaging abutment means between the cable management member and the ground blade to prevent the ground blade from backing out of the housing.

12. The system of claim 10 wherein said ground blade is generally planar and includes a slot, and said cable management member includes a portion projecting through the slot and between the positioning arms.

13. The system of claim 10, including a pair of said positioning arms projecting from each opposite side of the ground blade, with a partition on the cable management member extending between each pair of arms to define four quadrants for accommodating four coaxial cables.

14. The system of claim 13, including four of said terminal-receiving passages in the housing aligned with said four quadrants for receiving four signal terminals.

15. The system of claim 10 wherein said housing includes at least one locating recess and the cable management member includes at least one locating projection disposed in the recess.

16. The system of claim 15 wherein said locating projection is on an arm of the cable management member, and including a shield about at least a portion of the housing and engageable with the arm to hold the cable management member on the housing.

17. The system of claim 15 wherein said locating projection is press-fit into said locating recess.

18. The system of claim 10, including a shield about at least a portion of the housing and engaging at least a portion of the cable management member to hold the member on the housing.

* * * * *